United States Patent [19]

Wagner et al.

[11] 4,357,867

[45] Nov. 9, 1982

[54] MULTIPLE COIL HAMMER ACTUATOR SYSTEM

[75] Inventors: Richard E. Wagner, Auburn; C. Gordon Whitaker, Mercer Island, both of Wash.

[73] Assignee: Mannesmann Tally Corporation, Kent, Wash.

[21] Appl. No.: 134,347

[22] Filed: Mar. 27, 1980

[51] Int. Cl.[3] ..... B41J 9/12

[52] U.S. Cl. ..... 101/93.09; 101/93.04; 101/93.48

[58] Field of Search ..... 101/93.09, 93.16, 93.48, 101/93.04, 93.29, 93.34; 400/157.2, 157.3

[56] References Cited

U.S. PATENT DOCUMENTS

| | | | |
|---|---|---|---|
| 3,782,278 | 1/1974 | Barnett et al. | 101/93.04 |
| 4,080,892 | 3/1978 | Imahashi | 101/93.04 |

OTHER PUBLICATIONS

Abraham, et al., "Multiple Energy Print Hammer", IBM Technical Disclosure Bulletin, vol. 15, No. 1, Jun. 1972.

*Primary Examiner*—Clifford D. Crowder

*Attorney, Agent, or Firm*—Christensen, O'Connor, Johnson & Kindness

[57] ABSTRACT

A print hammer actuator system for a dot matrix line printer comprising a plurality of coils greater than the number of dot imprinting hammers to be actuated by the coils is disclosed. The coils (C1, C2 . . . C80 or 61, 62, 63 . . . 69) are mounted side-by-side in a fixed position; and, the hammers (H1, H2 . . . H40 or 51, 53, 55, 57) are oscillated back and forth in the regions where magnetic fields are produced by energized coils. As the hammers are oscillated, the coils are selectively energized and de-energized to actuate the hammers. Energizing the coils attracts the hammers toward the coils, against the spring force of the hammers. De-energizing the coils releases the hammers, whereby the stored spring energy creates a dot. Depending upon the position of the hammers, either one or two coils are energized and de-energized to actuate a single hammer.

10 Claims, 10 Drawing Figures

| | DOT COL 16 | DOT COL 15 | DOT COL 14 | DOT COL 13 | DOT COL 12 | DOT COL 11 | DOT COL 10 | DOT COL 9 | DOT COL 8 | DOT COL 7 | DOT COL 6 | DOT COL 5 | DOT COL 4 | DOT COL 3 | DOT COL 2 | DOT COL 1 |
|---|---|---|---|---|---|---|---|---|---|---|---|---|---|---|---|---|
| COIL 61 | O | O | O | O | O | O | O | O | O | O | O | O | X | O | X | O |
| COIL 62 | O | O | O | O | X | O | X | O | X | O | X | O | X | O | X | O |
| COIL 63 | X | O | X | O | X | O | X | O | X | O | X | O | X | O | X | O |
| COIL 64 | O | O | O | O | O | X | O | X | O | X | O | X | O | X | O | X |
| COIL 65 | O | X | O | X | O | X | O | X | O | X | O | X | O | X | O | X |
| COIL 66 | O | O | O | O | X | O | X | O | X | O | X | O | X | O | X | O |
| COIL 67 | X | O | X | O | X | O | X | O | X | O | X | O | X | O | X | O |
| COIL 68 | O | O | O | O | O | X | O | X | O | X | O | X | O | X | O | X |
| COIL 69 | O | X | O | X | O | X | O | X | O | X | O | X | O | X | O | X |

Fig. 10.

MULTIPLE COIL HAMMER ACTUATOR SYSTEM

TECHNICAL AREA

This invention relates to hammer actuators and, more particularly, to hammer actuators for printers wherein coils are energized and de-energized to control the actuation of print hammers.

BACKGROUND OF THE INVENTION

Various types of hammer actuator systems for use in dot matrix and other types of printers have been proposed and are in use. In most print hammer actuators systems, hammer actuation is controlled by controlling the current flow through coils. The coils produce magnetic fields that interact with the hammers (which may comprise several elements at least one of which is formed of a ferromagnetic material) so as to pull the hammers against a spring force and then release the electromagnetic pulling force whereby the stored spring force creates hammer actuation. Hammer actuation creates a character or a portion thereof (e.g., a dot) on a suitable print receiving medium.

One type of printer wherein such hammer actuator systems have found widespread use is the dot matrix line printer. Dot matrix line printers are produced by the Tally Corporation, Kent, Wash.; and, an example of a dot matrix line printer is described in U.S. Pat. No. 3,782,278, entitled IMPACT LINE PRINTER by David L. Barnett et al., assigned to the Tally Corporation. In a dot matrix line printer, a plurality of print hammers are oscillated (moved back and forth) between a print receiving medium (e.g., paper) and a line of actuating coils. In the past, in dot matrix line printers of the type described in the foregoing patent, each hammer has been associated with a single coil. The coils have been mounted in a fixed position and the related hammer has remained in the narrow region where the coils' magnetic field strength is adequate to actuate the related hammer. More specifically, as the hammers are oscillated the coils are selectively energized to pull the hammers away from the print receiving medium and, thereby, stress the hammer springs. The hammers are then released, whereby dots are created on the print receiving medium. After each dot line is completed, the paper is incremented and the hammers are oscillated in the opposite direction during which time a second line of dots is created in predetermined positions. A series of dot lines creates a line of characters. The characters may be formed by 5×7 or 7×9 dot matrix arrays, for examples.

While, in the past, in general, a single coil has been dedicated to a single hammer in dot matrix line printers, a recently issued patent (U.S. Pat. No. 4,080,892), entitled APPARATUS FOR DRIVING DOTTING HAMMERS OF A MATRIX PRINTER by Issei Imahashi (U.S. Pat. No. 4,080,892), has suggested using either of two coils to actuate a single dot printing element. More specifically, in this printing arrangement the coils are mounted in a fixed position on one side of the print receiving medium. The dot printing elements are located on the other side of the print receiving medium and movable back-and-forth in the magnetic fields produced by energized coils. Two coils are associated with each hammer and either (but not both) of the coils can be used to pull the hammer toward the print receiving medium to create a dot. Which coil is chosen to be energized, of course, depends upon the position of the hammer when a dot is to be printed. In other words, the pitch or spacing arrangement of the parallel electromagnets is preferably half of the pitch arrangement of the electromagnetic plates to be attracted.

In prior art dot matrix line printers that have had a one-to-one coil/hammer relationship character width has been very limited when the coils are mounted in a fixed position and the hammers are oscillated. This limitation exists because, when the hammers are moved very far from the coils, the attraction force for a fixed amount of energization rapidly drops whereby the printed dots become lighter. This limitation has restricted such printers to the printing of relatively narrow characters, such as the English language characters. It has been difficult, and in many cases impossible, to print wider characters (such as those common to Asian and African languages) of uniform intensity dots, without making the resulting printer overly complex and, therefore, undesirably expensive. For example, while the amount of power applied to the coils could be made to depend upon hammer position, such an approach requires an expensive electronic control system having undesirable time delays. Moreover, the size of the required power supply would have to be relatively large, whereby additional cooling would be required, both of which would increase the costs of such a printer. Printers using coil/hammer relationships where multiple coils can act one-at-a-time on a single hammer have similar disadvantages. For example, relatively light dots are created in the space between coils, whereby such systems create difficult to read characters even though they have the inherent ability to create relatively wide characters. Moreover, prior art dot matrix line printers have been difficult to use to create graphs, drawings and the like, all of which require that a dot printer have the ability to create a continuous line of similar intensity dot across substantially an entire page of the print receiving medium.

While the present invention was developed for use in connection with dot matrix line printers of the types briefly described above, it should be understood that the invention can also be used with other types of mechanical mechanisms to control the actuation of hammer-type elements.

It is an object of this invention to provide a new and improved hammer actuator system.

It is a further object of this invention to provide a print hammer actuator system wherein the magnetic fields produced by adjacent coils cooperate to actuate the print hammers.

It is another object of this invention to provide a dot matrix line printer hammer actuator system wherein the magnetic fields produced by two adjacent coils cooperate to actuate a single print hammer.

It is a still further object of this invention to provide a new and improved dot matrix line printer having the capability of producing dots of substantially the same intensity at substantially any horizontal position across a print receiving medium.

SUMMARY OF THE INVENTION

In accordance with this invention a hammer actuator system that is particularly suitable for use in a dot matrix line printer is provided. The hammer actuator system comprises a plurality of coils greater in number than the number of hammers to be actuated by the coils. The coils are mounted in a fixed position and the hammers are oscillated through the region where magnetic fields are produced by energized coils. As the coils are selectively energized and deenergized, the hammers are actuated by being attracted away from, and then released toward, the print receiving medium. Pulling the hammers away from the print receiving medium acts against a spring force whereby the hammers are cocked. Releasing the hammers allows the stored spring energy to drive the hammers toward the print receiving medium to create an image. Depending upon the position of the hammers, either one or two adjacent coils act on a single hammer. When two adjacent coils act on a single hammer, they are simultaneously energized.

In one preferred embodiment of the invention, the number of hammers is equal to one-half the number of coils and the distance between the centerlines of the hammers is equal to the distance between the centerlines of alternate coils. (Alternatively, if desired, other numerical relationships can be used.) In this embodiment of the invention, the range of oscillation or movement of the hammers is from a position in alignment with one of a pair of adjacent coils to a position in alignment with the other of the pair of adjacent coils. In an alternative preferred embodiment of the invention, the number of hammers is equal to one less than one-half the number of coils. In this embodiment of the invention, a trio of side-by-side coils is associated with each hammer. The hammers are moved from a position in alignment with one of the coils to a position in alignment with another coil, with an intermediate coil being located between the first and other coils. The end coils of each trio of coils forms the end coil of the next adjacent trio.

In general, printers utilizing embodiments of the invention wherein pairs of coils are dedicated to single hammers are ideally suited for use in creating relatively wide characters at discrete print positions. Contrariwise, printers wherein trios of coils share end coils are ideally suited for use in creating graphical or other images, or characters at nondiscrete positions.

As will be appreciated from the foregoing brief summary, the invention is particularly adapted for use with dot matrix line printers. In such an environment, the invention overcomes the disadvantages of prior art dot matrix line printers by substantially increasing the readable width of characters that can be printed and providing the ability to create graphs, charts, and other images. Since the readable width of characters is increased without the power supply output being varied in accordance with hammer position, a relatively inexpensive power supply control system can be used. While the imaging ability of such printers is increased, care must still be taken to prevent unselected hammers from being inadvertently actuated. Preferably, as in the past, this is accomplished by creating groups of coils and selectively energizing coils or coil pairs of each group to create the desired dot arrays in a hammer such that coils or coil pairs are spaced apart far enough to avoid inadvertent hammer actuation.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein.

DESCRIPTION OF THE PREFERRED EMBODIMENT

Figure 1:
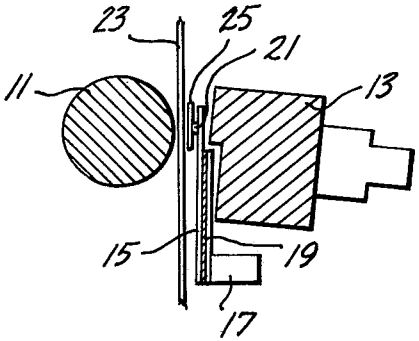
FIG. 1 is a cross-sectional view illustrating the major print creating components of a dot matrix line printer.

FIG. 1 is a cross-sectional view of the major elements of one type of dot matrix line printer adapted to create dots, which combine to form an image, i.e., a character, graph, picture, etc. The elements illustrated in FIG. 1 include an elongate, cylindrical platen 11 and a plurality of coils 13. The coils 13 are mounted side-by-side along an axis that lies parallel to the longitudinal axis of the platen 11. (Because FIG. 1 is a cross-sectional view, only a single coil can be seen.) The platen 11 is rotatable about its longitudinal axis; and, the coils 13 are mounted in a fixed position. Located between the coils 13 and the platen 11 are the movable tips of a plurality of elongate hammers 15. The base of the hammers 15 are affixed to a suitable longitudinal support 17. Depending upon the design of the hammers, they may be individual elements or may have a common base. In either case they are in the overall form of a comb. Regardless of how they are configured, the hammers are formed of a resilient (e.g., spring-like) ferromagnetic material. If desired, a plurality of elongate dampers 19 may be juxtaposed on the side of the hammers 15 facing the coils 13.

Affixed to the movable tip of each hammer, on the side facing the plate 11 (so as to be tangential to the platen) is a dot printing element 21. In addition, located between the dot printing element and the platen 11 is a print receiving medium (e.g., paper) 23. Located between the dot printing element 21 and the paper is a ribbon 25.

While the platen 11 and the coils 13 are mounted in fixed positions in a printer housing (not shown), the hammer mechanism which comprises the hammers 15, damper 19 and associated support 17, is longitudinally movable (i.e., in and out with respect to the cross-sectional plane of FIG. 1). Depending upon the specific movement mechanism, the hammer movement can be stepped or continuous. In the stepping case, preferably, the hammers are moved by a stepping motor. In the continuous case, preferably, a DC motor is utilized to move the hammers. In any event, the hammer mechanism is end supported by flexures and coupled to the movement mechanism. As the hammers are moved, the coils 13 are selectively energized and de-energized. When a coil is energized, it attracts an associated hammer. The attraction is such that the hammer spring force is overcome. After a predetermined period of time, coil energization ends and the "cocked" hammer is released. When a hammer is released, the stored spring energy drives the hammer tip toward the platen, whereby a dot is imprinted on the paper. After the desired dots of a particular row of dots are printed, the paper is incrementally moved and the next row of dots is printed. If the image is a series of characters, a predetermined number of dot rows creates a row of characters.

While the foregoing description should be adequate for a general understanding of the operation of dot matrix line printers, attention is directed to U.S. Pat. No. 3,782,278 entitled IMPACT LINE PRINTER by David L. Barnett et al. assigned to the assignee of the present application for a more complete understanding of this subject matter.

As discussed in U.S. Pat. No. 3,782,278, and other documents describing dot matrix line printers of the foregoing type produced by the Tally Corporation, Kent, Wash., in the past, the number of hammers of such printers is usually equal to the number of hammer actuating coils. Moreover, in the past the hammers have been oscillated over a limited range in front of their related coils. As the hammers reach predetermined positions in their limited range of oscillation, they are selectively actuated. In order to prevent the electromagnetic energy produced by nearby coils from actuating the hammers related to adjacent coils, the coils are grouped. For example, each group may comprise five adjacent coils. Only one coil of each group is simultaneously energized. More specifically, each hammer of prior art dot matrix line printers of the type described in the foregong patent ranges over one character position (i.e., a given hammer always prints at a given character position). However, all of the hammers are not withdrawn and released simultaneously due to the possibility of inadvertent actuation of adjacent hammers. For example, if the second and fourth hammers are commanded to print a dot and the third hammer is commanded not to print a dot, and if all of the hammers are simultaneously commanded, it is possible that the coils associated with the second and fourth hammers will produce a magnetic field adequate to inadvertently actuate the third hammer. While the resultant dot may not be dark, even a light dot is unacceptable. As a result, only one hammer of each group of hammers is actuated at a time. There are other advantages to this sequential actuation technique. For example, actuating hammers in this sequential manner, reduces the peak current drain on the hammer power supply. Further, impact noise and mechanical strain are reduced.

As previously stated, each hammer ranges over only one character position. Looking at any individual hammer in slow motion as it covers a character position will show the hammer starting with the first dot position of a character matrix (preferably the upper left-hand corner position of the matrix). When in this position, the hammer is actuated to create a dot, if commanded to do so by the controlling electronics. If no dot is required in the first dot position for the desired character, the hammer is not commanded to be actuated. Regardless of whether the hammer prints or does not print a dot, the same amount of time is involved. Thereafter the hammer (actually the entire print comb) is moved one dot position in a predetermined direction (e.g., to the right) and either does or does not print a dot in that position, depending on the requirements of the particular character. The hammer then moves one more position in the same direction and does or does not print a dot in that position. It then moves one more dot position in the same direction and does or does not print a dot. After the required number of dot positions for one row are scanned, the paper is advanced one dot row and the hammer is controlled to print the dot requirements of the character in the second row, this time starting at the end side of the previous row (e.g., the right end position) and moving in the opposite direction (e.g., to the left). This zig-zag path of travel continues until all of the rows of a particular line of characters have been scanned. Then the paper is advanced by the character row separation distance and the first dot row of the next row of characters is scanned.

As noted above, in the past, printers of the type previously described have had a one-to-one hammer/coil relationship. That is, each hammer acted on a single related hammer, and thus, was dedicated thereto. More recently, a proposal has been made to allow two adjacent coils to actuate a single hammer—see U.S. Pat. No. 4,080,892 referenced above. However, even this system only energizes one coil of the pair of associated coils to actuate the related hammer at any point in time. That is, even though two coils are associated with a single hammer, systems of the type described in U.S. Pat. No. 4,080,892 do not provide for the simultaneous energization of both coils to actuate their common hammer. As a result dots created at hammer positions between coil positions are likely to be lighter than dots created at positions in substantial alignment with coil positions, assuming uniform coil actuation energy. As will be better understood from the following description, the present invention provides coil actuator systems wherein two coils may be simultaneously energized and their combined magnetic field used to actuate a single hammer. This coil sharing ability provides a printer having the ability to produce uniform images over larger character widths (or the entire width of the image receiving medium) and, thus, a printer having greatly expanded capabilities.

Figure 2:
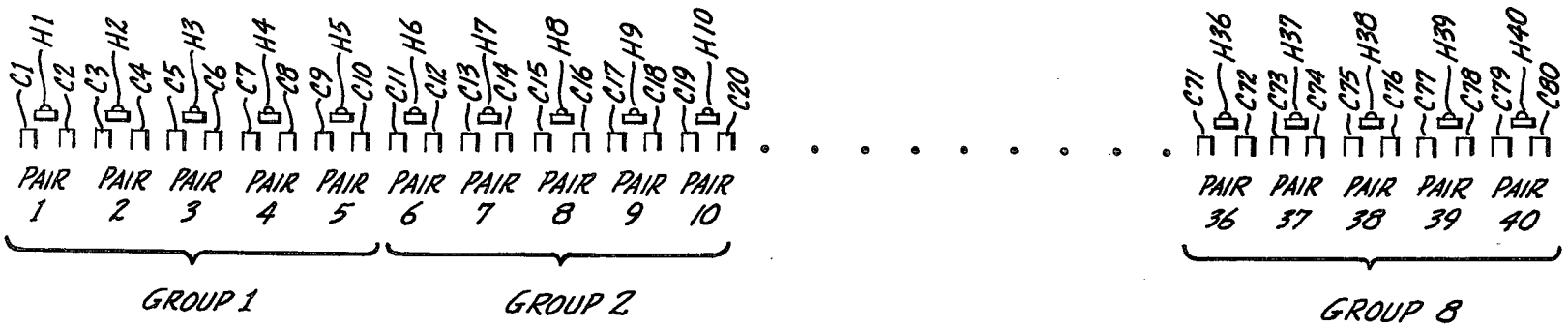
FIG. 2 is a schematic diagram illustrating coil and hammer groups formed in accordance with one embodiment of the invention.

FIG. 2 is a schematic diagram illustrating a coil/hammer group arrangement for use in a multiple coil hammer actuator system formed in accordance with the invention. For purposes of illustration, FIG. 2 shows a system of eighty (80) coils divided into eight (8) groups of ten (10) coils each. Each pair of coils is associated with a single hammer. Thus, each group of coils is associated with five hammers. As will be better understood from the following discussion, as in prior art printers, the group technique herein described has the benefit of reducing the instantaneous load on the power supply that energizes the coils.

For purposes of this description, the numbers designating particular groups, hammers and coils read from left to right in FIG. 2. The five pairs of coils included in Group 1 are designated Pair 1, Pair 2, Pair 3, Pair 4 and Pair 5. Pair 1 comprises two coils designated C1 and C2; Pair 2 comprises two coils designated C3 and C4 . . . and, Pair 5 comprises two coils designated C9 and C10. The first hammer, designated H1, is associated with Pair 1, i.e., C1 and C2; the second hammer designated H2, correspondently is associated with C3 and C4 . . . ; and, the fifth hammer, which is designated H5, is correspondently associated with C9 and C10. Group 2 also includes five pairs of coils designated Pair 6, Pair 7, Pair 8, Pair 9 and Pair 10. Pair 6 comprises two coils designated C11 and C12; and, is associated with the sixth hammer, designated H6. In a similar manner, the Group 2 pairs of coils are associated with particular coil designation and hammers through Pair 10, which comprises two coils designated C19 and C20 that are associated with the tenth hammer, designated H10. Groups 3, 4, 5, 6 and 7, which are not specifically shown in FIG. 2, likewise comprise pairs of coils and associated hammers identified by increasing numerical values. The final group, Group 8, also includes five pairs of coils designated Pair 36, Pair 37, Pair 38, Pair 39 and Pair 40. Pair 36 comprises two coils designated C71 and C72, which are associated with a thirty-sixth hammer designated H36. Pair 37, Pair 38 and Pair 39 are likewise associated with number identified pairs of coils and hammers. The final pair, Pair 40, comprises two coils designated C79 and C80 and an associated hammer designated H40.

As noted above, the layout illustrated in FIG. 2 is exemplary of one particular embodiment of the invention. It is to be understood that greater or lesser than eight groups can be utilized if desired. In addition, each group can comprise greater or less than five pairs of coils, if desired. The major restriction of this particular type of embodiment of the invention is the two coil, single hammer association. (In other types of embodiments, more than two coils may be associated with a single hammer.) As will be better understood from the following detailed description of the type of embodiment of the invention illustrated in FIG. 2, depending upon the position of the hammer, either one or the other of the two coils separately, or both coils in combination, are energized to actuate an associated hammer.

Figure 4:
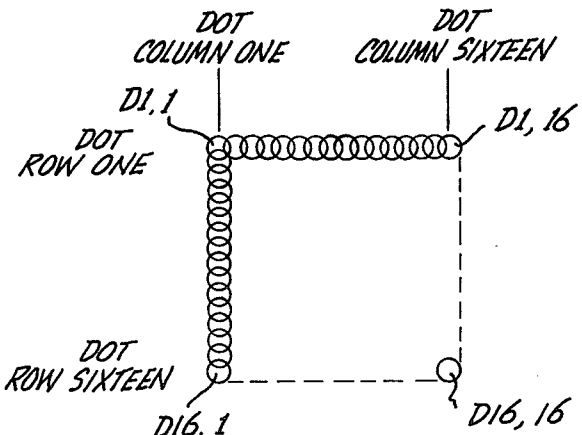
FIG. 4 is a pictorial view of a dot row/column character array created by a printer formed in accordance with the invention.
Figure 3:
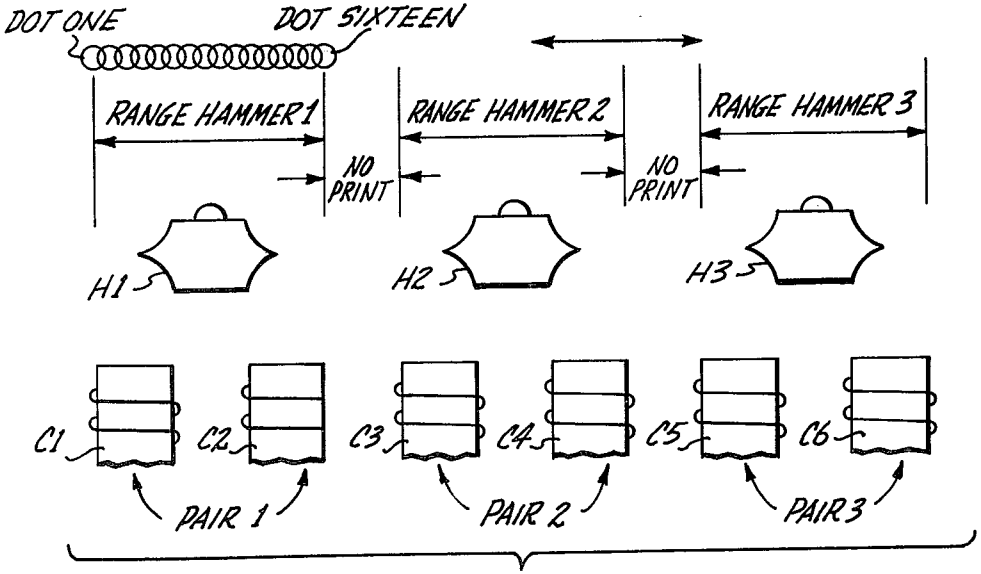
FIG. 3 is an enlarged diagram of a portion of one of the coil and hammer groups illustrated in FIG. 2.

FIG. 3 is an enlarged schematic diagram illustrating the first three pairs—Pair 1, Pair 2 and Pair 3—of the first group (Group 1) of the hammer/coil combinations illustrated in FIG. 2. Thus, FIG. 3 comprises C1, C2 . . . C6 and H1, H2 and H3. As denoted by the horizontal bidirectional arrow, the hammers are movable back and forth in front of the coils. The coils are mounted in fixed positions in a housing (not shown) and positioned such that the magnetic field produced when a particular coil is energized attracts a hammer, located in front of the coil, toward the coil. Thus, the hammers are moved back and forth in the region where magnetic fields are produced by energized coils. The range of hammer movement is from a position where a particular hammer lies substantially in alignment with its associated left-most coil to a position where the same hammer lies substantially in alignment with its associated right-most coil. The hammers oscillate between these two extreme or end positions. The range of hammer movement is denoted by the terms Range Hammer 1, Range Hammer 2 and Range Hammer 3 in FIG. 3. Located between adjacent hammer end positions are no-print areas. Thus, a no-print area lies between C2 and C3, between C4 and C5, etc. As illustrated above the Range Hammer 1 term in FIG. 3, dots are printed at chosen positions in the range. In the illustrated embodiment of the invention sixteen (16) dot positions are chosen to create a complete horizontal character line. As illustrated in FIG. 4, preferably, a complete character also has sixteen (16) row positions whereby the matrix of a complete character is a 16×16 matrix. For purposes of position identification, the row numbers run from top to bottom and the column numbers run from left to right. Thus, each matrix position can be identified in an X, Y manner wherein the first number identifies the row and the second number identifies the column. Thus, D1, 1 defines the upper left-hand corner of the matrix and D1, 16 defines the upper right-hand corner. As will be appreciated by those familiar with dot matrix line printers, a 16×16 matrix is substantially larger than the standard 5×7 or 7×9 matrices utilized by most prior art dot matrix printers to create English language characters. As a result, the invention is ideally suited for printing the characters of languages that are larger in size and more complex than English language characters. For example, the invention is ideally suited for forming the characters of the languages of Far Eastern countries (i.e., Korean, Japanese, Chinese, etc.). In addition, the invention is ideally suited for forming characters of the language of North African countries.

Figure 5:
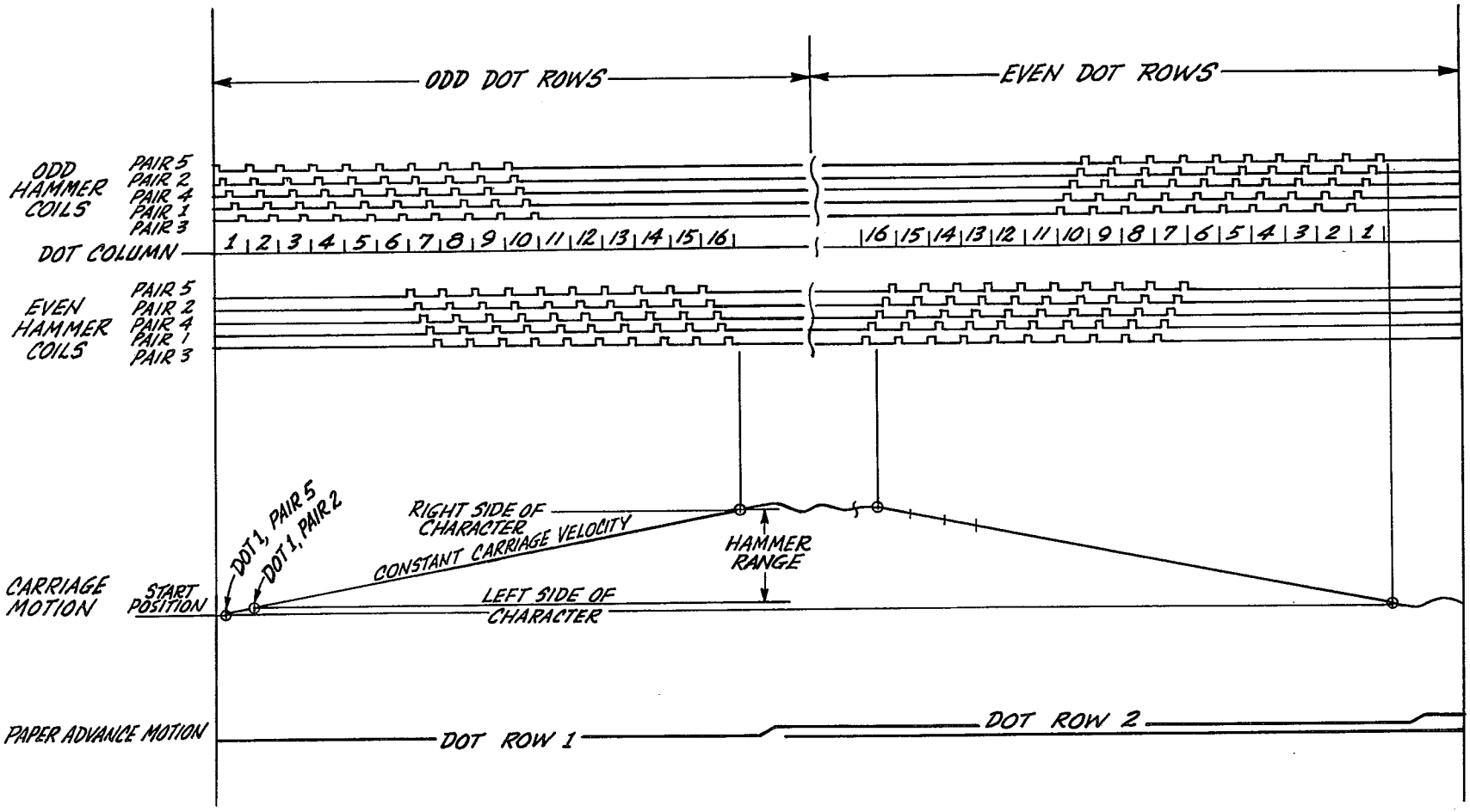
FIG. 5 is a timing diagram illustrating the preferred sequence of energization of the coils of a dot matrix line printer utilizing the coil and hammer grouping arrangement illustrated in FIG. 2.

FIG. 5 is a timing diagram illustrating the preferred coil energization sequence of a dot matrix printer formed in accordance with the embodiment of the invention illustrated in FIGS. 2–4. The upper five lines of FIG. 5 illustrate the energization of ood numbered hammer coils. The sixth line denotes the sixteen (16) dot column positions. The seven through eleven lines illustrate the energization of the even numbered hammer coils. The twelfth line illustrates the back and forth motion of the hammers; and, the thirteenth line illustrates when paper advancement motion occurs. Further, the left side illustrates the sequence of hammer actuation when the hammers are moved from left to right (odd dot rows—1, 3 . . . ) and the right side of FIG. 5 illustrates the sequence of hammer actuation when the hammers are moved from right to left (even dot rows—2, 4 . . . ).

Turning first to the first five lines of FIG. 5, when the hammers are in positions to create dots at any one of column positions 1, 2, 3, 4, 5 and 6, only the odd numbered coils, C1, C3, C5 . . . C79 are energized. Obviously, if a dot is not to be created, the odd coils are not energized. Rather, actual energization only occurs if a dot is to be printed at a particular dot column position for the character that is to be formed by the matrix of which that particular dot column is a part. Further, while only the odd numbered coils are energized in column positions 1–6 (if required) they are not simultaneously energized. Rather, each dot column position is broken into five segments, one of which is related to a particular hammer pair of each group, as shown in the first five lines of FIG. 5. Moreover, adjacent odd numbered coils (i.e., C1 and C3, C3 and C5, etc.) are not sequentially energized. Rather, as shown in the first line of FIG. 5, first the odd numbered coil of the fifth pair of coils of each group (i.e., C9, C19, C29 . . . C79) are energized, as required. Next, as shown in the second line, the odd numbered coil of the second pair of coils of each group (i.e., C3, C13, C23 . . . C73) are energized, as required. Then, as shown in the third line, the odd numbered coil of the fourth pair of coils of each group (i.e., C7, C17, C27 . . . C77) are energized, as required. Next, as shown in the fourth line, the odd numbered coil of the first pair of coils of each group (i.e., C1, C11, C21 . . . C71) are energized, as required. Finally, as shown in the fifth line, the odd numbered coil of the third pair of coils of each group (i.e., C5, C15, C25 . . . C75) are energized, as required.

It will be appreciated from the foregoing description of the energization sequence illustrated in FIG. 5 that adjacent odd numbered coils are never sequentially energized. Rather, at least one odd numbered coil (plus two even numbered coils) are located between sequentially energized odd numbered coils.

Preferably, the hammers are moved back and forth in front of the coils by a constant speed carriage movement mechanism. As a result, as soon as the odd numbered coil of the third pair of coils of each group has been energized (if required), the hammers enter column position 2 and the odd numbered coil of the fifth pair of coils of each group is again energized (if required). Thereafter, the foregoing sequence is finished for column position 2, then repeated for column position 3, column position 4, column position 5 and, finally, column position 6.

At column position 7, both the odd and the even numbered coils related to the hammers are simultaneously energized. Again, however, the sequence of energization is that adjacent odd/even pairs are not simultaneously energized. More specifically, the same sequence (i.e., fifth, second, fourth, first and third coil pairs) occurs. However, as noted, rather than only the odd numbered coils being energized at their related position segment, both the odd and even numbered coils are energized. More specifically, first the odd and even numbered coils forming the fifth pair of coils at each group (i.e., C9, C10, C19 and C20 . . . C79 and C80) are simultaneously energized, as required. Next the odd and even numbered coils forming the second pair of coils of each group (i.e., C3 and C4, C13 and C14, . . . C73 and C74) are energized, as required. Then, the odd and even numbered coils forming the fourth pair of coils in each group (i.e., C7 and C8, C17 and C18, . . . C77 and C78) are energized, as required. Next, the odd and even numbered coils forming the first pair of coils of each group (i.e., C1 and C2, C11 and C12 . . . C71 and C72) are simultaneously energized as required. Finally, the odd and even numbered coils forming the third pair of coils of each group (i.e., C5 and C6, C15 and C16, . . . C75 and C76) are simultaneously energized, as required. Thereafter, dot column position number 8 is entered; and, the foregoing sequence is repeated. The simultaneous energization of both the odd and even numbered coils (as required) occurs when the hammers are in dot column positions 7, 8, 9 and 10, as shown in the first through fifth and the seventh through eleventh lines of FIG. 5.

Starting with dot column positon 11 extending through dot column position 16, only the even numbered coils of each pair of coils are energized. While only the even numbered coils are energized, the segment sequence of energization within the dot column positions remains the same. Thus, the even numbered coils of the fifth pair of coils of each group (i.e., C10, C20 . . . C80) are first energized, as required, as shown in the seventh line of FIG. 5. Next, the even numbered coil of the second pair of coils of each group (i.e., C4, C14, C24 . . . C74) are energized, as required—see the eighth line of FIG. 5. Then, the even numbered coil of the fourth pair of coils of each group (i.e., C8, C18, C28 . . . C78) are energized, as required—see the ninth line. Next, the even numbered coil of the first pair of coils of each group (i.e., C2, C12, C22 . . . C72) are energized, as required—see the tenth line. Finally, the even numbered coil of the third pair of coils of each group (i.e., C6, C16, C26 . . . C76) are energized, as required—see the eleventh line of FIG. 5.

After the even numbered coil of the third pair of coils of each group has been energized at dot column position 16 (if required), the first row of dots is complete. That is, scanning of the first dot row is now complete. At this point, movement of the hammers from left to right ends and the hammers begin to move from right to left. Prior to the right-to-left interval of movement, as illustrated in the bottom line of FIG. 5, the paper is advanced by the amount of space taken up by one dot row, minus any desired overlap.

As the hammers are moved from right to left, the even/odd coil sequence of energization is reversed. Further, the segment sequence (within each dot column position) is reversed. More specifically, the dot column position sequence is 16, 15, 14, 13, . . . 1. When the hammers are in dot column positions 16, 15, 14, 13, 12 and 11, only even numbered coils are energized. In positions 10, 9, 8, and 7 both odd and even numbered coils are simultaneously energized. In dot column position 6, 5, 4, 3, 2 and 1, only odd numbered coils are energized. And, rather than following a fifth, second, fourth, first and third segment sequence of energization, the segment sequence followed is third, first, fourth, second and fifth.

Other than the foregoing sequence changes, the energization of the odd and even numbered coils is the same as described above for left-to-right hammer movement. After the left-most dot column position (i.e., dot column position 1) is reached, the paper is advanced and the carriage moving the hammers again reverses direction. Thereafter the hammers are moved from left to right and the left-to-right sequence of operation described above is repeated.

As will be appreciated from the foregoing description, dots are printed (as required) in odd numbered rows during left-to-right hammer movement and in even numbered rows during right-to-left hammer movement. As previously discussed, after sixteen (16) dot rows have been scanned and dots created (as required for the characters to be printed), a line of characters is completed. At this point, the paper is advanced by the desired line spacing distance and the first dot row of the next line of characters is scanned and dots printed, as required.

Figure 6:
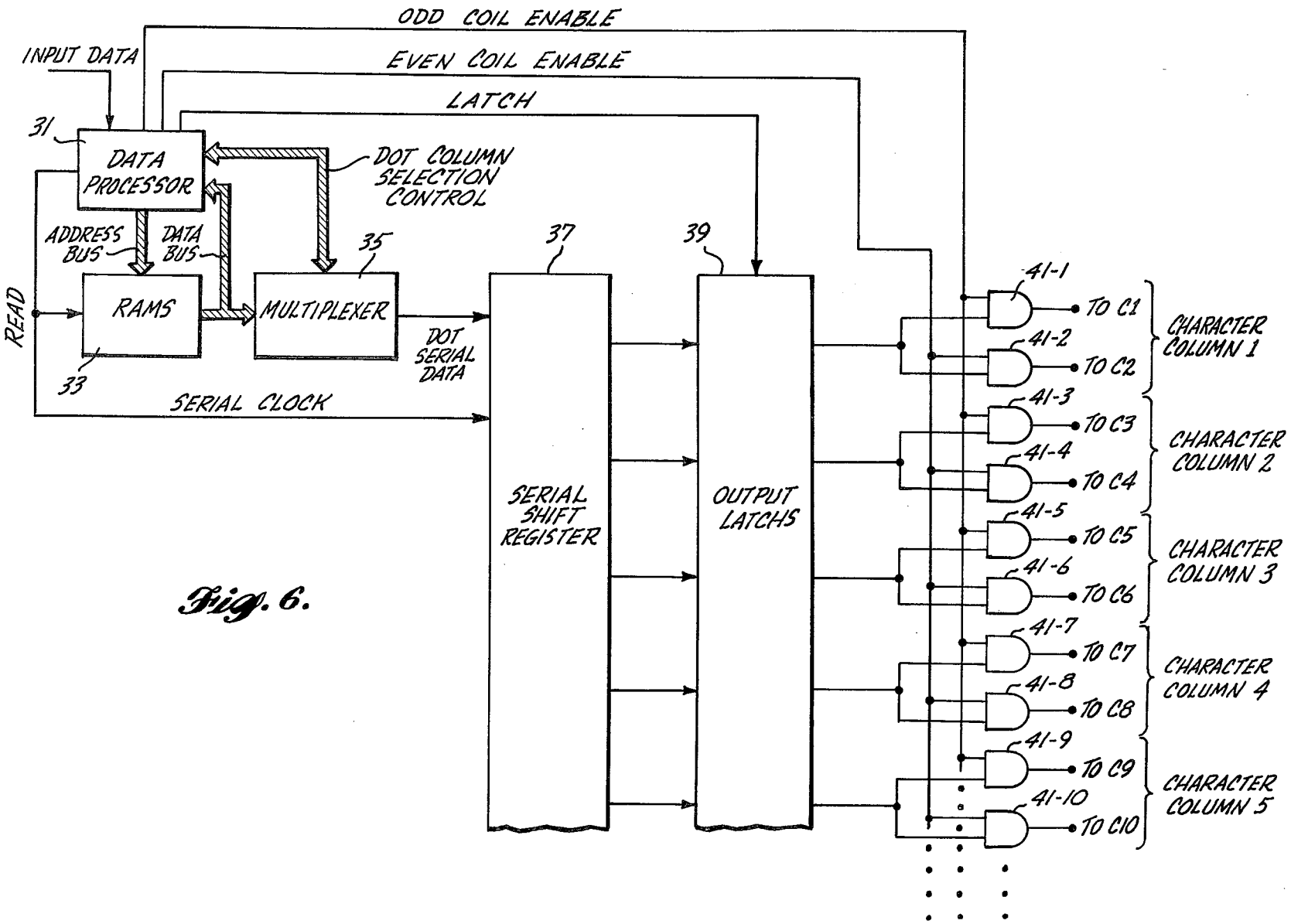
FIG. 6 is a block diagram of a coil energization control system suitable for controlling the energization of the coils of a dot matrix line printer functioning in accordance with the timing diagram illustrated in FIG. 5.

FIG. 6 is a simplified block diagram of a control system suitable for controlling the energization of the coils that control the actuation of the hammers of a dot matrix printer of the type illustrated in FIGS. 2 and 3. The control system illustrated in FIG. 6 comprises: a data processor 31; one or more random access memories (RAMs) 33; a multiplexer 35; a serial shift register 37; an output latch 39; and, a plurality of two-input AND gates 41-1, 41-2, 41-3, etc.

The data processor 31 receives character defining data (denoted INPUT DATA) from any suitable digital data source. As it is received, the character defining data is stored in a suitable temporary memory, which forms part of the data processor. After a line of character defining data has been received and stored, the data processor sequentially produces the character defining data on an address bus connected to the RAMs. The sequence follows the printing sequence outlined above.

The RAMs 33 store control data defining whether or not a dot is to be produced at each matrix position of each possible character. That is the RAMs store control data about whether or not a dot is to be produced at each position of the 16×16 dot matrix illustrated in FIG. 4 (or any other dot matrix if a different number, e.g., 5×7, 7×9, etc., is chosen) for each possible character. When the RAMs are addressed, they are addressed in a manner that causes them to produce data for a complete row, or a portion of a row, for the chosen character. For example, if the RAMs produce 16-bit parallel data, the binary state of each of the 16 bits denotes whether or not a dot is to be produced at a related column position of the chosen row of the character. Alternatively, if the RAMs only produce an 8-bit parallel output, then two 8-bit outputs are necessary to define all of the column position of the chosen dot row.

As noted above, while the character defining data stored in the data processors memory is sequentially produced, the order of production is not a simple, numerical progression across the line of characters (i.e., character position 1, character position 2, etc., through character position 40). Rather, the character data is produced for one character position of each group in a manner illustrated in the FIG. 5 timing diagram and previously described. Moreover, character data for the appropriate character position of the last group (Group 8) is produced first followed by the production of the character data for the same character position of the next group in descending numerical order, i.e., Group 7, Group 6, etc. This sequence continues through Group 1. Then the character data for the next character position of Group 8 is produced and the sequence repeated for the same character position in Group descending order. This sequence of operation is illustrated in FIG. 7 and hereinafter described in detail.

In addition, each time a character defining data is produced, the data processor simultaneously produces a row defining data, starting with row one (1) and running through the last row of the character matrix (i.e., row sixteen of the character matrix illustrated in FIG. 4). Of course, as will be better understood from the following description of FIG. 7, the same row defining data is continuously produced until all of the character defining data for that row has been produced the required number of times to cover the total number of dot column positions.

The inputs of the multiplexer 35 are connected to the data output bus of the RAMs, which bus is also connected to the data processor 31. As will be better understood from the following description, because only a particular dot column position of a character is selected at any particular point in time, the multiplexer only looks at one of the 16 (or 8) available data bits each time that the multiplexer is commanded to apply one of its plural inputs to its output. The data processor produces selection control signals that control the multiplexer's operation. The selection control signals are denoted DOT COLUMN SELECTION CONTROL in FIG. 6. The multiplexer output data is in serial form and identified as DOT SERIAL DATA in FIG. 6. The DOT SERIAL DATA is applied to the data input of the serial shift register 36. The serial shift register also receives a clock signal denoted SERIAL CLOCK in FIG. 6. The SERIAL CLOCK signal is the same as the READ signal applied to the RAMs by the data processor, which signal causes the RAMs to read the address on the ADDRESS BUS and produce the data stored at the related address. Thus, the shift register is clocked and shifts data each time the RAMs are commanded to read a new address.

Figure 7:
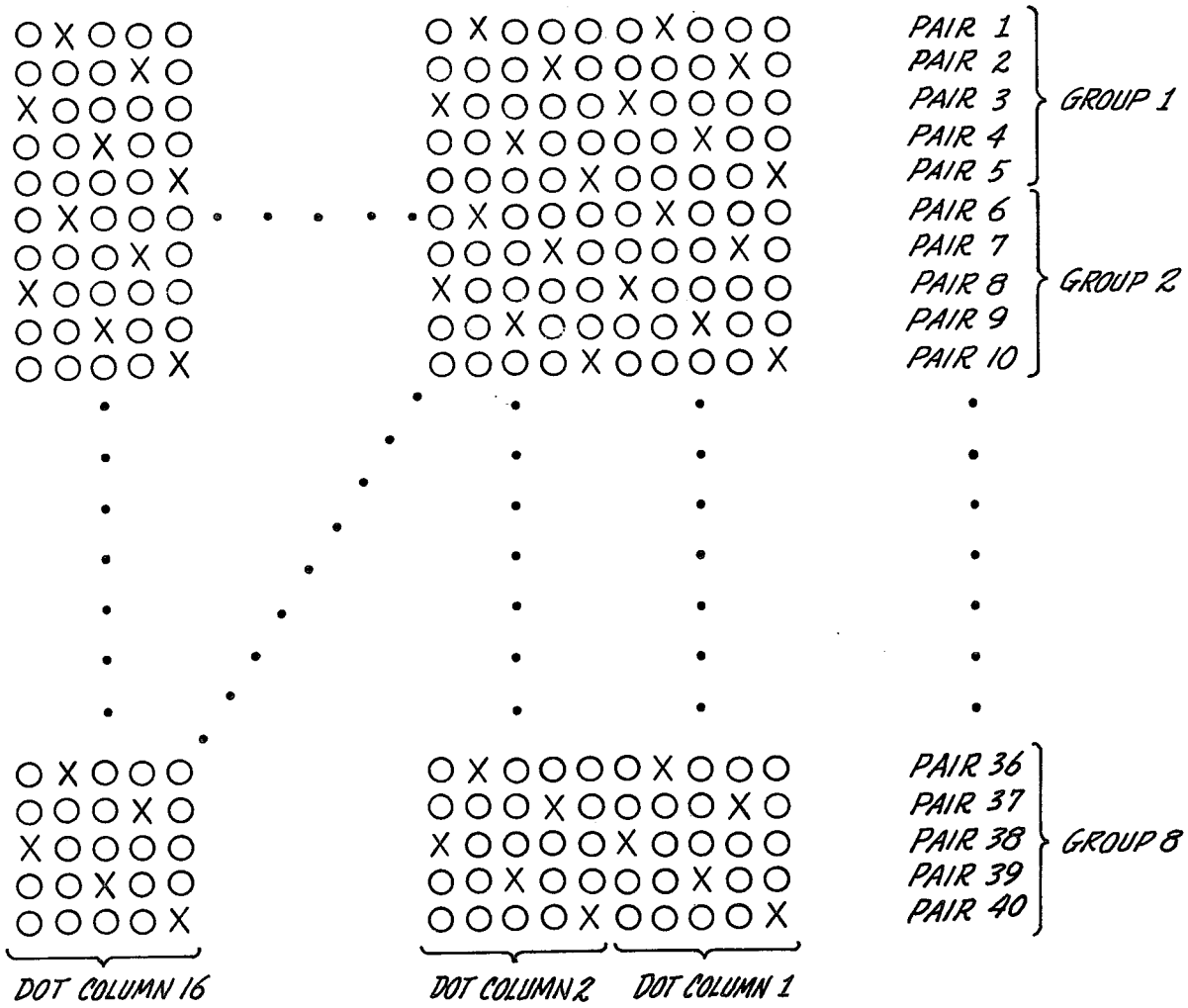
FIG. 7 is an energization graph illustrating the sequence of energization of the coils of a coil and hammer grouping arrangement of the type illustrated in FIG. 2 timed in accordance with the timing diagram illustrated in FIG. 5.

In order to better understand the nature of the DOT SERIAL DATA produced at the output of the multiplexer 35 and applied to the serial shift register 37, attention is directed to FIG. 7. The following description assumes that: scanning of the character matrix starts with the hammers in the dot column one (1) position of dot row 1 (the D1, 1 position of FIG. 4); the last stage of the serial shift register controls the actuation of the last hammer; the serial shift register 37 has stages equal in number to the number of hammers (e.g., forty); and, the timing sequence is as illustrated in FIG. 5 and previously described.

FIG. 7 is a table comprising a series of columns formed of circles and X's. The circles denote binary zeros. The X's denote data, which may be a binary one, if the related hammer is to be actuated to produce a dot, or a binary zero, if the related hammer is not to be actuated. As indicated on the right side of FIG. 7, each row of each column of the table relates to a particular coil pair, which in turn relates to a particular hammer. All of the relationships are numerically associated as previously described.

The lowest row of data illustrated in FIG. 7 is adapted to control the coil pair that actuates H40. The next lowest row controls the coil pair that actuates H39; the next lowest row controls the coil pair that actuates H38, etc. Finally, the top row controls the coil pair that actuates H1. The DOT SERIAL DATA stream starts at the lower right corner of FIG. 7 and proceeds up the first column, followed by the second column (starting at the bottom) and proceeding in this manner to the left-most column.

Since the coil pair that actuates H40 is the fifth coil pair of Group 8 (which is the first coil pair actuated during left-to-right movement), the data stream starts by the multiplexer reading data related to the D1, 1 position of the character to be printed by H40. At this point in time, of course, the data processor 31 is producing an address on the output of the address RAMs 33 that identifies the appropriate character, plus the fact that row 1 data is desired. It is the DOT COLUMN SELECTION CONTROL signal that causes the multiplexer to output the first column data bit of row 1, i.e., the D1, 1 data bit for this character position. The next four bits (going up column 1) are zeros because the next four data bits control the operation of coil pairs 39, 38, 37, and 36, which are inactive during the first segment of dot column position 1, as previously described. After the four zeros have been produced, the RAMs 33 are addressed to produce data for the first row of the character to be produced by H35. Again, this is done by producing the character identifying data and row one data on the address bus. The multiplexer is commanded to read the column one (1) data bit. Thereafter, the multiplexer 35 is commanded to produce four additional zeros; and, then, the RAMs are addressed to produce the data for row 1 of the character to be produced by H30; and, the multiplexer is commanded to read the column one (1) data bit. Thereafter, four zeros are produced by the multiplexer. This sequence continues until the data for the D1, 1 position of the character to be produced by H5 occurs, followed by four additional zeros. As noted above, the foregoing series of data is illustrated in the right-most column of the data matrix illustrated in FIG. 7, starting at the bottom of the column and proceeding to the top. As this series of data is produced, it is shifted into the serial shift register 37. After the entire line of data has been shifted into the serial shift register 37, the output latch 39 is actuated to read the data in the serial shift register.

Each data output of the output latches is connected to control the energization of a related coil pair. Specifically, the output latch adapted to store the last bit of DOT SERIAL DATA (upper right-hand corner of FIG. 7) is connected to the data input of the first and second AND gates 41-1 and 41-2, which are connected to control the energization of odd coil C1 and even coil C2, respectively. Similarly, the output latch adapted to store the second to the last bit of DOT SERIAL DATA is connected to the data inputs of the third and fourth AND gates 41-3 and 41-4, which are connected to control the energization of odd coils C3 and C4, respectively. This arrangement extends through the output latch adapted to store the first bit of DOT SERIAL DATA, which is connected to the data inputs of the seventy-ninth and eightieth AND gates (not illustrated in FIG. 6) connected to control the energization of odd coil C79 and even coil C80, respectively. The other inputs of the AND gates connected to the odd coils all receive an ODD COIL ENABLE signal, produced by the data processor. Similarly, the other inputs of the AND gates connected to the even coils receive an EVEN COIL ENABLE control signal, also produced by the data process. Either or both of the odd or even coils can be energized in accordance with the timing diagram illustrated in FIG. 5 and discussed above.

After the first line of DOT SERIAL DATA has been shifted into the serial shift register 37 in the manner previously described and, thence, to the output latch 37, it is available to simultaneously control the operation of all of the hammers controlled by the fifth pair of coils of each group. Since the hammers are in the dot column position one (1), only the odd numbered coils are energized. Consequently, only an ODD COIL ENABLE signal is applied to the odd numbered AND gates 41-1, 41-3, etc. When this signal occurs, the odd coils are energized in accordance with the data on the output of the latches. Obviously, the odd coils of the first, second, third and fourth pairs of coils of the groups are not energized since their respective data bits are all binary zeros. Thus, the hammers related to these coils are not actuated. The odd coils of the fifth pair of coils of each group are energized if their respective data bits are binary ones and not energized if their respective data bits are binary zeros.

After the data controlling coil energization for the D1, 1 position of the matrix produced by the fifth hammer of all of the groups has been shifted from the serial shift register to the output latch 39 for use in controlling the energization of the fifth pair of coils of each group as just described, the multiplexer 35 starts to serialize the second line of coil energization control data and shift it into the serial shift register 37. This line of data is represented by the next to the right-most column of data in FIG. 7. In this case, the first three bits are zero. Next, the data processor produces a character and row one address for the character to be produced by H37 (the second hammer of Group 8). Thereafter, four zeros are produced on the output of the multiplexer. Next, the data processor addresses the RAMs to cause the production of the data for the D1, 1 position of the character to be printed by H32. The sequence of operation continues until all of the data necessary for controlling the D1, 1 position energization of all of the second hammers of the eight groups have been interleaved with zeros and shifted into the shift register. This data is then transferred to the latches and used to simultaneously actuate the odd coils of the second pair of coils of each group, as determined by the nature of the data bits. A similar sequence of operation is followed for the fourth, first and third pairs of coils of each group. The related data streams are set forth in the third, fourth and fifth right-most columns of FIG. 7, respectively, moving from bottom to top. Thereafter, the entire sequence is repeated for dot column position D1, 2, followed by a repeat of the sequence for dot column position D1, 3, and so on through dot column position D1, 16. When the control data for the last segment of the D1, 16 position have been serialized, latched and used to control the even coils of the third pair of coils of each group, the portion of the timing diagram on the left side of FIG. 5 will have been completed. In order to cover this single row of dot positions, 5 (segments)×40 (coil pairs)×16 (column position) or 3,200 data bits will have been shifted through the shift register.

After the first dot row is completed, the second dot row is scanned following the timing diagram illustrated on the right side of FIG. 5 and previously described. As the various segments of the column positions occur, appropriate character and row (2) addresses are produced on the address bus of the data processor. The RAMs, in turn, produce appropriate control data, which is interleaved with zeros by the multiplexer under the control of the data processor in the manner previously described. After the second dot row scanning is completed, the third dot row is scanned, following the same timing diagram as the first dot row. This manner of operation continues through the sixteenth dot row. By the end of the sixteenth dot row 51,200 data bits will have been shifted through the serial shift register. Of course, only one fifth (1/5) or 10,240 of these data bits will be character printing control data bits, the remainder being binary zeros. These exemplary numbers assume, of course, that forty (40) hammers and, thus, a maximum of forty (40) characters comprise a row of characters. Obviously, other maximum character numbers can be chosen. Similarly, these exemplary numbers assume that the character matrix is a sixteen by sixteen (16×16) matrix. Obviously, other matrix sizes can be chosen, if desired, whereby the foregoing numbers would also change accordingly.

It is, of course, to be understood that when the hammers are in a position requiring that both coils be simultaneously energized, when the dots are to be actually printed, both ODD and EVEN COIL ENABLE pulses are applied to the AND gates illustrated in FIG. 6 and previously described. Similarly, when the hammers are in a position such that only the even coils are to be energized, only an EVEN COIL ENABLE signal is applied to the AND gates.

Figure 8:
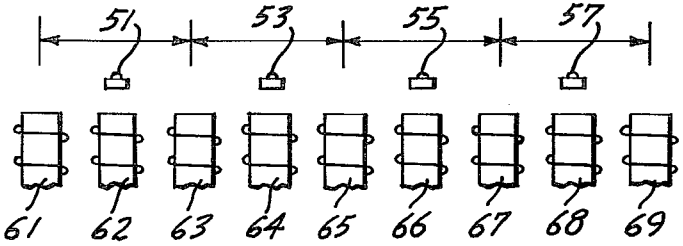
FIG. 8 is a schematic diagram of the coil/hammer arrangement of an alternate form of a dot matrix line printer formed in accordance with the invention.
Figure 9:
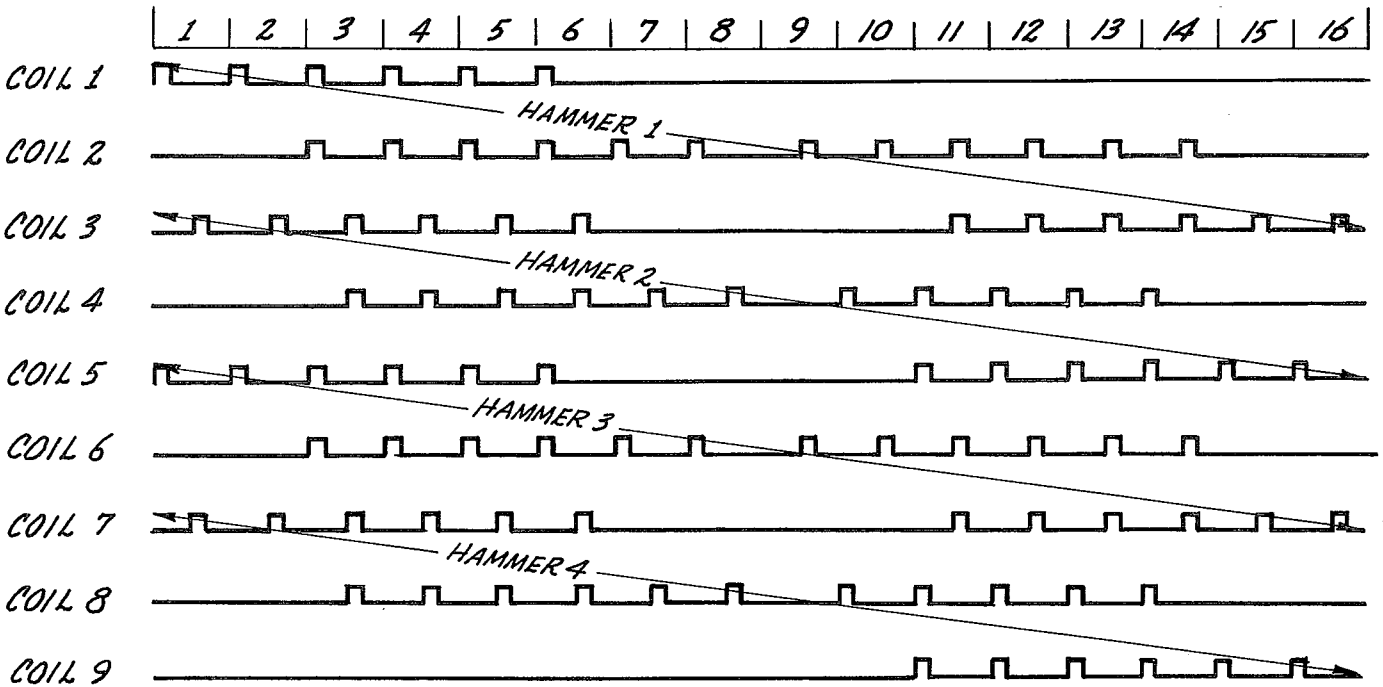
FIG. 9 is a timing diagram illustrating the preferred sequence of energizing the coils of a dot matrix line printer coil/hammer arrangement of the type illustrated in FIG. 8; and, FIG. 10 is an energization graph illustrating the sequence of energization of the coils illustrated in FIG. 8 based on the timing diagram of FIG. 9.

It will be appreciated from the foregoing discussion that the previously described embodiment of the invention is adapted to produce characters separated by no-print regions, as illustrated in FIG. 3. Moreover, it will be appreciated that with this arrangement, a single pair of coils is dedicated to a single hammer. Contrariwise, the embodiment of the invention illustrated in FIG. 8 and hereinafter described is adapted to create a continuous row of dots across the sheet of paper. As a result, this embodiment of the invention is ideally suited to creating graphic figures, photographic reproductions and other images, as well as characters, if desired. In addition, as will be better understood from the following description of the embodiment of the invention illustrated in FIG. 8, these results are accomplished by pairs of hammers sharing coils, depending upon the position of the hammers in their range of movement. In this regard, the range of hammer movement lies between the centerline of one coil and the centerline of another coil, with a further coil being located therebetween. The range of the next adjacent hammer begins at the centerline of the other coil and extends to the centerline of yet another coil with a still further coil being located therebetween. As a result, of course, the timing of the actuation of the hammers of the embodiment of the invention illustrated in FIG. 8 is different than the timing of the embodiment of the invention heretofor described. A suitable timing diagram is illustrated in FIG. 9 and hereinafter described.

FIG. 8 illustrates an embodiment of the invention comprising nine coils 61-69 and four hammers 51, 53, 55 and 57. As with the previously described embodiment of the invention, the hammers are mounted on a carriage moved by a mechanism (not illustrated) in the region where magnetic fields are produced by energized coils and actuated thereby. Depending upon the position of the hammers in their range of movement one or two coils are energized to actuate a hammer.

As illustrated by the arrows at the top of FIG. 8, the hammers are movable from a position where they lie along the centerline of one coil to a position where they lie along a centerline of another coil, with a further coil being located between the two centerline coils. For example, the first hammer 51 is movable through a range of positions extending from the centerline of the first coil 61 to the centerline of the third coil 63, with the second coil 62 being positioned between the first and third coils. Similarly, the second hammer 53 is movable through a range of positions extending from the centerline of the third coil 63 to the centerline of the fifth coil 65, with the fourth coil 64 being located between the third and fifth coils. In a similar manner, the fourth hammer 55 is movable through a range of positions extending from the centerline of the fifth coil 65 to the centerline of the seventh coil 67, with the sixth coil 66 being located between the fifth and seventh coils. Finally, the fourth hammer 57 is movable through a range of positions extending from the centerline of the seventh coil 67 to the centerline of the ninth coil 69, with the eighth coil lying between the seventh and ninth coils. As will be readily appreciated from the foregoing discussion, the hammers range over the entire region lying between the centerlines of the first coil 61 and the ninth coil 69 with no open or dead spaces therebetween.

As also will be readily appreciated from FIG. 8 and the foregoing description, either the first, second or third coils alone, or the pairs of coils comprising the first and second coils or the second and third coils, are adapted to control the actuation of the first hammer 51. Similarly, the third, fourth of fifth coils either alone or in adjacent combination are adapted to control actuation of the second hammer 53. As a result, it will be observed that the third coil 63 is shared by the first and second hammers 51 and 53. Similarly, the fifth coil 65 is shared by the second and third hammers 53 and 55; and, the seventh coil is shared by the third and fourth hammers 55 and 57. How the coils illustrated in FIG. 8 are controlled is shown in the FIG. 9 timing diagram and the control dot matrix diagram illustrated in FIG. 10, both of which are next described.

FIGS. 9 and 10 assume for purposes of discussion that there are sixteen (16) discrete hammer actuation positions for the four hammers of the embodiment of the invention illustrated in FIG. 8. (Obviously other numbers of actuation positions can be chosen, as desired). In addition, each hammer position is chosen to have two actuation segments (as opposed to the five segments illustrated in FIG. 5 for the embodiment of the invention illustrated in FIGS. 2 and 3). This segment arrangement allows one or both of the odd hammers 51, 55 and one or both of the even hammers 53, 57 to be actuated without the actuation of an intermediate hammer of the other variety, i.e., even or odd, occurring. For exampe, using dot column position one (1) as an example when the hammers are in their left-most position, either the first coil or the fifth coil can be energized. As a result, either or both of the odd hammers 51 and 55 can be actuated simultaneously during this period of time. During the second segment of dot column position one (1) either the third coil or the seventh coil can be energized, if desired. As a result, either or both of the even hammers 53 and 57 can be actuated simultaneously. This odd and even hammer actuation sequence occurs during each of dot column positions one (1) through eight (8). Starting from the ninth position, the actuation sequence changes to an even-odd hammer actuation sequence.

FIG. 10 is a data matrix generally similar to FIG. 7 illustrating the production of serialized data utilized to control the energization of the first through ninth coils illustrated in FIG. 8. The control is in accordance with the timing diagram illustrated in FIG. 9 and described above. If desired, a control system of the type illustrated in FIG. 6 can be utilized to control the production of data in accordance with the data matrix illustrated in FIG. 10. In essence, the data processor controls the RAMs so that suitable image data is produced for coil control in accordance with the timing diagram. Interleaved between data bits are binary zero coil control bits. For example, for dot column position number one (1) two sets of data are serially shifted into the shift register and latched through the output latches to the coils for the two segments previously discussed. The first set of serial data comprises four zeros for controlling the sixth through ninth coils 66, 67, 68 and 69. The fifth coil 65 is controlled by a data bit. Three zeros follow the data bit that controls the fifth coil for controlling the second through fourth coils 62, 63 and 64. Finally, a data bit is produced for controlling coil one 61. The series of data for controlling the second segment comprises two zeros for controlling the eighth and ninth coils 68 and 69 followed by a data bit for controlling the seventh coil 67. Thereafter three binary zero data bits occur for controlling the fourth through sixth coils 64, 65, 66 and 67. Then, a data bit occurs for controlling the third coil 63. Finally, two binary zeros occur for controlling the first and second coils 61 and 62.

Obviously, the foregoing sequence of operation is merely exemplary and any other suitable sequence can be utilized, as desired. Further, if desired, a number of hammers and controlling coils can be substantially increased. For example, forty (40) hammers controlled by eighty-one (81) coils that can be utilized, if desired. Alternatively, any other number of hammers can be chosen, maintaining the relationship $H=2C+1$, where H equals the number of hammers and C equals the number of coils.

It will be appreciated from the foregoing description that the invention provides new and improved dot matrix line printing mechanisms having the ability to print characters substantially larger and more complex than English language characters. In this regard, as noted above, in general, English language characters have been generally produced in a 5×7 or 7×9 dot matrix array. In general, such an array is too small to clearly print characters of other languages, such as Japanese, Chinese, Korean, etc. The invention provides a dot matrix printing mechanism of the line printer type for use in producing such characters out of dots of substantially equal intensity, without varying the intensity of the power used to energize the coils. In addition, certain embodiments of the invention are ideally suitable for creating graphical and other images, in particular the embodiment of the invention illustrated in FIG. 8. Again, equal intensity dots are created without requiring that the power applied to the coils be controlled in accordance with hammer position.

While preferred embodiments of the invention have been illustrated and described, it will be appreciated that various changes can be made therein without departing from the spirit and scope of the invention. For example, as discussed above, timing formats other than those specifically illustrated herein can be utilized, if desired. Further, control systems other than the control system illustrated in FIG. 6 can be utilized to control the energization of the coils. Hence, the invention can be practiced otherwise than as specifically described herein.

The embodiments of the invention in which an exclusive property or privilege is claimed are defined as follows:

1. A multiple coil/hammer actuator system comprising:

a plurality of coils mounted side-by-side in a fixed position for producing, when energized, adjacent magnetic fields lying along a common axis;

a plurality of resilient hammer means, smaller in number than the number of coils, mounted for oscillatory movement in the adjacent magnetic fields produced by said plurality of coils, said oscillatory movement being such that at least a portion of each hammer means moves in the region wherein the magnetic fields are produced by at least two adjacent coils when said at least two adjacent coils are energized, said portion of said hammer means being formed of a ferromagnetic material that is attracted toward one or both of said at least two adjacent coils when said one or both of said at least two adjacent coils are energized, said attraction acting against said resilience of said resilient hammer means to create stored mechanical energy that is released when the energized one or both of said at least two adjacent coils is de-energized, said release creating a hammer actuation force; and, control means connected to said plurality of coils for controlling the energization of said plurality of coils such that one or both of the two adjacent coils related to each of said hammer means is selectively energized in accordance with the position of said related hammer means in the region where magnetic fields are produced by said at least two adjacent coils and the nature of a control signal.

2. A multiple coil/hammer actuator system as claimed in claim 1 wherein the number of coils is equal to twice the number of hammers and each pair of coils is dedicated to an associated hammer, said associated hammer being oscillated in the region where magnetic fields are produced by said dedicated pair of coils.

3. A multiple coil/hammer actuator system as claimed in claim 1 wherein said plurality of coils is equal to twice the number of said plurality of hammers plus one additional coil, said plurality of coils defining trios of coils with the end coil of one trio forming the end coil of the next adjacent trio and wherein said hammers are oscillated in the magnetic fields produced by an associated trio of coils.

4. In a dot matrix line printer wherein a plurality of resilient, at least partially ferromagnetic hammers are moved in the magnetic fields produced by a plurality of coils greater in number than the number of hammers, said coils mounted side-by-side along an axis lying parallel to the print line of said dot matrix line printer, each hammer being associated with and actuatable by more than one coil, said actuation occurring when said coils are selectively energized to draw an associated hammer from a quiescent position into a strained position to create stored mechanical energy that is released when energized coils are de-energized to create dots on a print receiving medium, the improvement comprising:

control means for controlling the selective energization of said coils such that a pair of coils associated with a single hammer are simultaneously energized to actuate said hammer.

5. The improvement claimed in claim 4 wherein each of said pair of coils associated with a single hammer are juxtaposed.

6. The improvement claimed in claim 5 wherein a trio of coils forms two pairs of coils both of which are associated with a single hammer.

7. The improvement claimed in claim 6 wherein the end coils of each of said trio of coils forms one of the coils of a next adjacent trio of coils.

8. A multiple coil/hammer actuator system for a dot matrix line printer wherein images are created by controlling the printing of dots in dot lines across a print receiving medium as the print receiving medium is stepped in a direction transverse to said dot line, said multiple coil/hammer actuator system comprising:

a plurality of coils, mounted side-by-side in a fixed position and along a common axis lying transverse to the direction of movement of said print receiving medium, for producing adjacent magnetic fields when energized;

a plurality of resilient hammer means, smaller in number than the number of coils, mounted for oscillatory movement in the adjacent magnetic fields produced by said plurality of coils and between said plurality of coils and said print receiving medium, said oscillatory movement being such that at least a portion of each hammer means moves in the region where the magnetic fields are produced by at least two adjacent coils when said at least two adjacent coils are energized, said portion of said hammer means being formed of a ferromagnetic material that is attracted toward said at least two adjacent coils when one or both of said two adjacent coils are energized, said attraction acting against said resilience of said resilient hammer means to create stored mechanical energy that is released when the energized one or both of said at least two adjacent coils is de-energized, said release creating a dot producing hammer actuation force; and, control means connected to said plurality of coils for controlling the energization of said plurality of coils such that one or both of the two adjacent coils related to each of said hammer means is selectively energized in accordance with the position of said related hammer means in the region where magnetic fields are produced by said at least two adjacent coils and the nature of a dot control signal.

9. A multiple coil/hammer actuator system for a dot matrix line printer as claimed in claim 8 wherein the number of coils is equal to twice the number of hammers and each pair of coils is dedicated to an associated hammer, said associated hammer being oscillated in the region where magnetic fields are produced by said dedicated pair of coils.

10. A multiple coil/hammer actuator system for a dot matrix line printer as claimed in claim 8 wherein said plurality of coils is equal to twice the number of said plurality of hammers plus one additional coil, said plurality of coils defining trios of coils with the end coil of one trio forming the end coil of the next adjacent trio and wherein said hammers are oscillated in the magnetic fields produced by an associated trio of coils.

* * * * *